US006254988B1

(12) United States Patent
Zhu et al.

(10) Patent No.: US 6,254,988 B1
(45) Date of Patent: Jul. 3, 2001

(54) COMFORTABLE CUT-ABRASION RESISTANT FIBER COMPOSITION

(75) Inventors: Reiyao Zhu, Midlothian; Larry John Prickett, Chesterfield; Michael R. Baron, Midlothian, all of VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/595,737

(22) Filed: Jun. 16, 2000

(51) Int. Cl.[7] ..... D01F 8/00; D01F 8/02; D01F 8/12

(52) U.S. Cl. ..... 428/373; 428/362; 428/365; 428/377

(58) Field of Search ..... 428/365, 362, 428/377, 370, 373; 57/230, 210, 211; 2/761.7

(56) References Cited

U.S. PATENT DOCUMENTS

| | | | |
|---|---|---|---|
| 4,470,251 | 9/1984 | Bettcher | 57/230 |
| 4,777,789 | 10/1988 | Kolmes et al. | 57/210 |
| 5,119,512 | 6/1992 | Dunbar et al. | 2/167 |
| 5,442,815 | 8/1995 | Cordova et al. | 2/161 |

*Primary Examiner*—N Edwards

(57) ABSTRACT

The present invention relates to a comfortable, cut resistant and abrasion resistant, composition composed of cotton, nylon, and p-aramid fibers and used primarily in the sheath for sheath/core yarns in protective apparel.

10 Claims, 4 Drawing Sheets

COMFORTABLE CUT-ABRASION RESISTANT FIBER COMPOSITION

BACKGROUND OF THE INVENTION

1. Field of the Invention

This invention relates to a composition useful for cut resistant and abrasion resistant sheath/core yarns that, when fabricated into protective garments, are effective and, also, comfortable to the wearer.

2. Description of Related Art

United States Pat. No. 4,470,251 granted Sep. 11, 1984 on the application of W. H. Bettcher discloses sheath/core yarns used in protective garments wherein the core is steel wire and p-aramid fibers and the sheath is wound on the core as at least one layer including an outer layer of nylon to provide a comfortable surface.

United States Pat. No. 4,777,789 granted Oct. 18, 1988 on the application of N. H. Kolmes et al. discloses sheath/core yarns for use in protective apparel wherein at lest one layer of the sheath construction includes a wire wrapping. The yarns can, also, include cotton and synthetic fibers such as nylon and aramid.

BRIEF SUMMARY OF THE INVENTION

A fiber composition is disclosed comprising; 5 to 60 weight percent cotton fibers; 10 to 65 weight percent nylon fibers having a length of 2.5 to 15 centimeters and a linear density of 0.5 to 7 dtex; and 30 to 85 weight percent p-aramid fibers having a length of 2.5 to 15 millimeters and a linear density of 0.5 to 7 dtex, wherein the weight percents are based on the total weight of the cotton, nylon, and p-aramid fibers and the cotton, nylon, and p-aramid fibers are combined to yield a substantially uniform mixture. The fiber composition of this invention is used, among other uses, as the sheath component of a sheath/core yarn construction wherein the core is a fibrous material having an overall linear density of 100 to 5000 dtex. The resulting sheath/core yarns are used, among other uses, to make knitted fabric for protective garments with a combination of high cut resistance, high abrasion resistance, and a high degree of comfort for wearers of the garments.

DETAILED DESCRIPTION OF THE INVENTION

Figure 1:
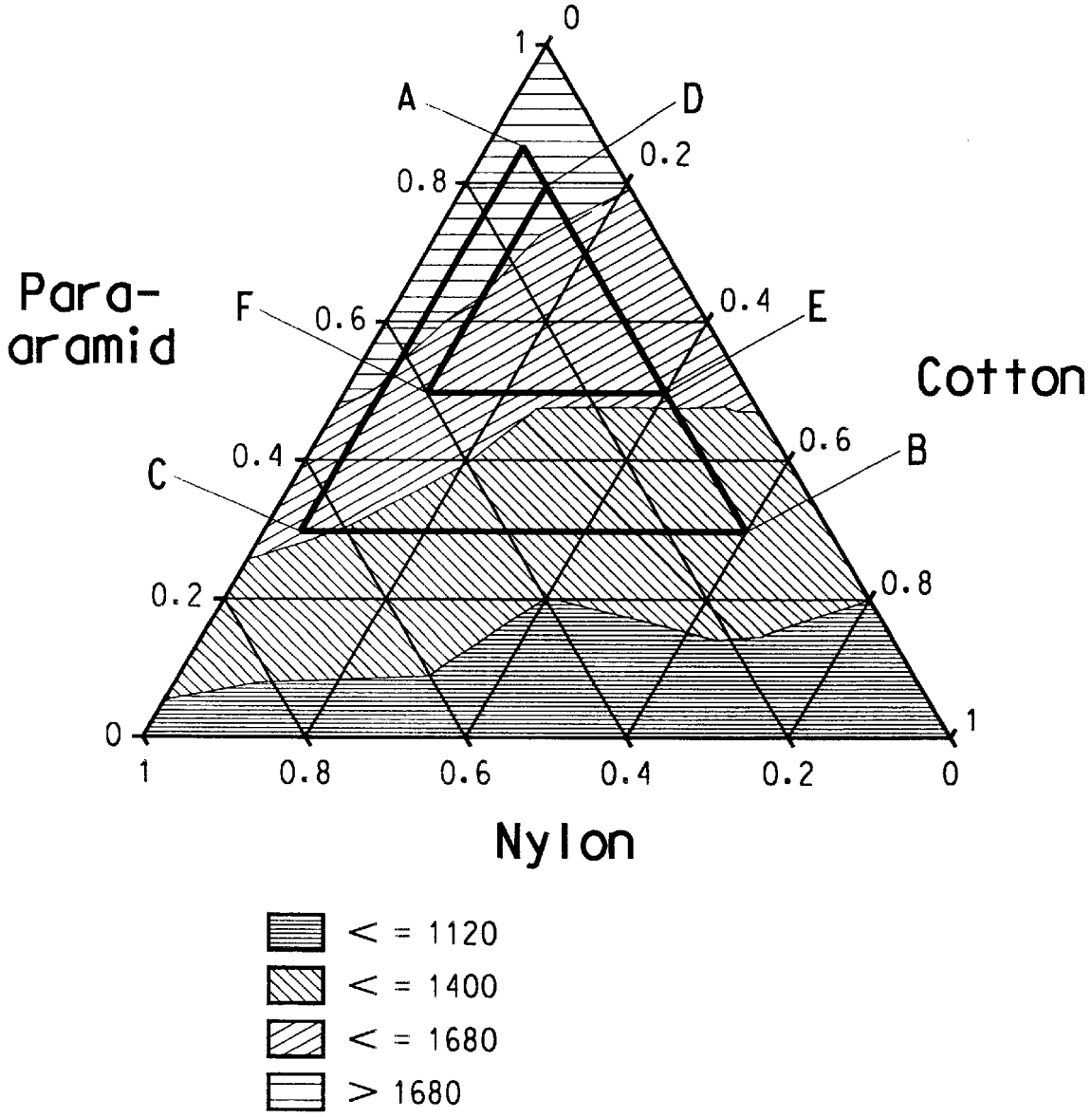
FIG. 1 is a ternary plot of cut resistance using the composition of this invention in a glass reinforced fabric.

There has long been a tension in the field of protective garments, between comfort and effectiveness; and considerable effort has been expended to increase the effectiveness while maintaining or improving the comfort. The present invention represents just such an advancement in the field of cut and abrasion resistant fabrics and apparel. By use of this invention, it is now possible to increase the cut and abrasion resistant effectiveness and maintain or improve the comfort, of fabrics and protective garments, such as cut and abrasion resistant gloves.

The composition of this invention finds use as a wrapping or sheath in sheath/core yarn structures wherein the core of the structure is glass fiber or metal fiber (wire) or some other material that is abrasive and hard. Such cores and core materials can be, for example, metal fibers having diameters of about 25–150 micrometers in one strand or more than one strand and in continuous form or as staple fibers. Glass fibers may, also, serve as core materials with diameters of about 1–30 micrometers and as one strand or more, in continuous or staple form. Cores of fibrous material used in practice of this invention generally have an overall linear density of 100 to 5000 dtex. The composition of this invention is carefully selected to provide cut resistance, abrasion resistance, and comfort for sheath/core yarns used in, for example, protective garments.

The fiber components of the composition of this invention are p-aramid, nylon, and cotton and the proportions of each component are important to achieve the necessary combination of physical qualities.

By para-aramid fibers is meant fibers made from para-aramid polymers; and poly(p-phenylene terephthalamide) (PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

P-aramid fibers are generally spun by extrusion of a solution of the p-aramid through a capillary into a coagulating bath. In the case of poly(p-phenylene terephthalamide), the solvent for the solution is generally concentrated sulfuric acid, the extrusion is generally through an air gap into a cold, aqueous, coagulating bath. Such processes are well-known and do not form a part of the present invention.

By nylon is meant fibers made from aliphatic polyamide polymers; and polyhexamethylene adipamide (nylon 66) is the preferred nylon polymer. Other nylons such as polycaprolactam (nylon 6), polybutyrolactam (nylon 4), poly(9-aminononanoic acid) (nylon 9), polyenantholactam (nylon 7), polycapryllactam (nylon 8), polyhexamethylene sebacamide (nylon 6, 10), and the like are, of course, also eligible.

Nylon fibers are generally spun by extrusion of a melt of the polymer through a capillary into a gaseous congealing medium. Such processes are well-known and do not form a part of the present invention. Cotton fibers used in practice of this invention can be any that are usually used in fabric and apparel applications. Cotton fibers are generally 1 to 7.5 centimeters long.

Synthetic staple fibers for use in spinning yarns are generally of a particular length and of a particular linear density. For use in this invention, synthetic fiber staple lengths of 2.5 to 15 centimeters (1 to 6 inches) can be used, and lengths of 3.8 to 11.4 centimeters (1.5 to 4.5 inches) are preferred. Yarns made from such fibers having staple lengths of less than 2.5 centimeters have been found to require excessively high levels of twist to maintain strength for processing; and yarns made from such fibers having staple lengths of more than 15 centimeters are more difficult to make due to the tendency for long staple fibers to become entangled and broken resulting in short fibers. The synthetic staple fibers can be crimped or not, as desired for any particular purpose. The staple fibers of this invention are generally made by cutting continuous filaments to certain predetermined lengths; but staple can be made by other means, such as by stretch-breaking; and yarns can be made from such fibers as well as from a variety or distribution of different staple fiber lengths. Staple synthetic fibers used in this invention have linear densities of 0.5 to 7 dtex.

Figure 2:
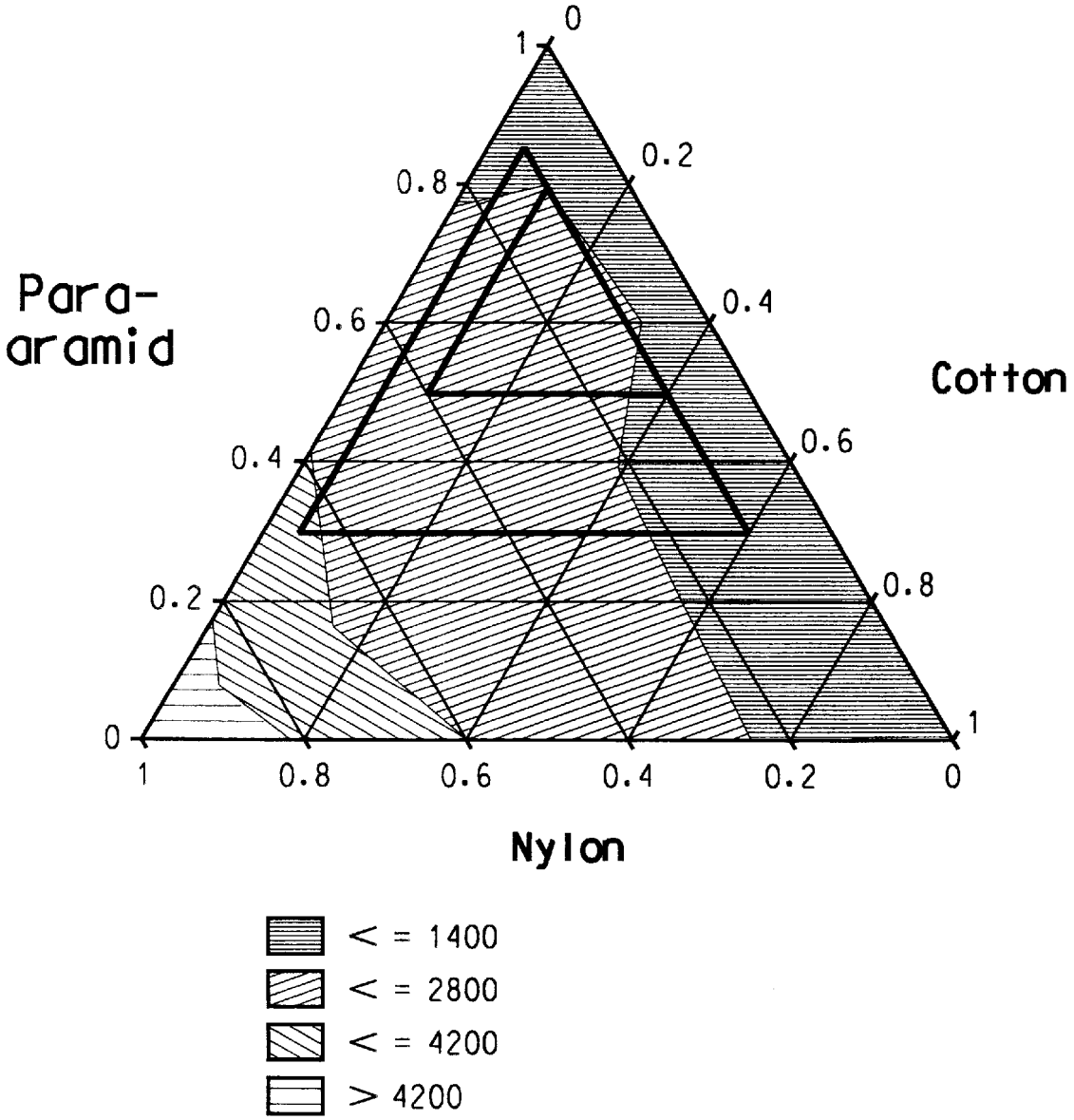
FIG. 2 is a ternary plot of abrasion resistance using the composition of this invention in a glass reinforced fabric.
Figure 3:
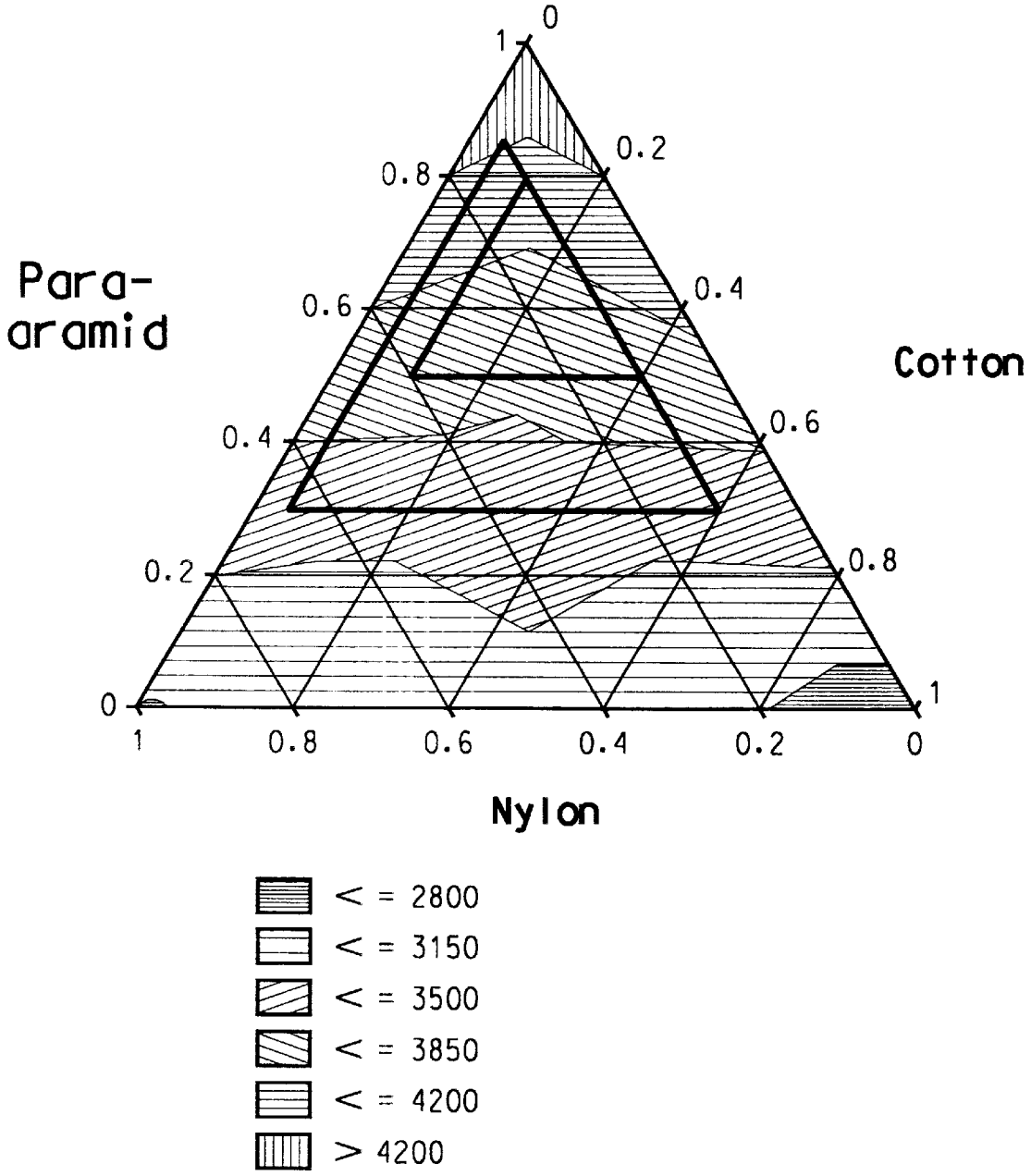
FIG. 3 is a ternary plot of cut resistance using the composition of this invention in a steel reinforced fabric.
Figure 4:
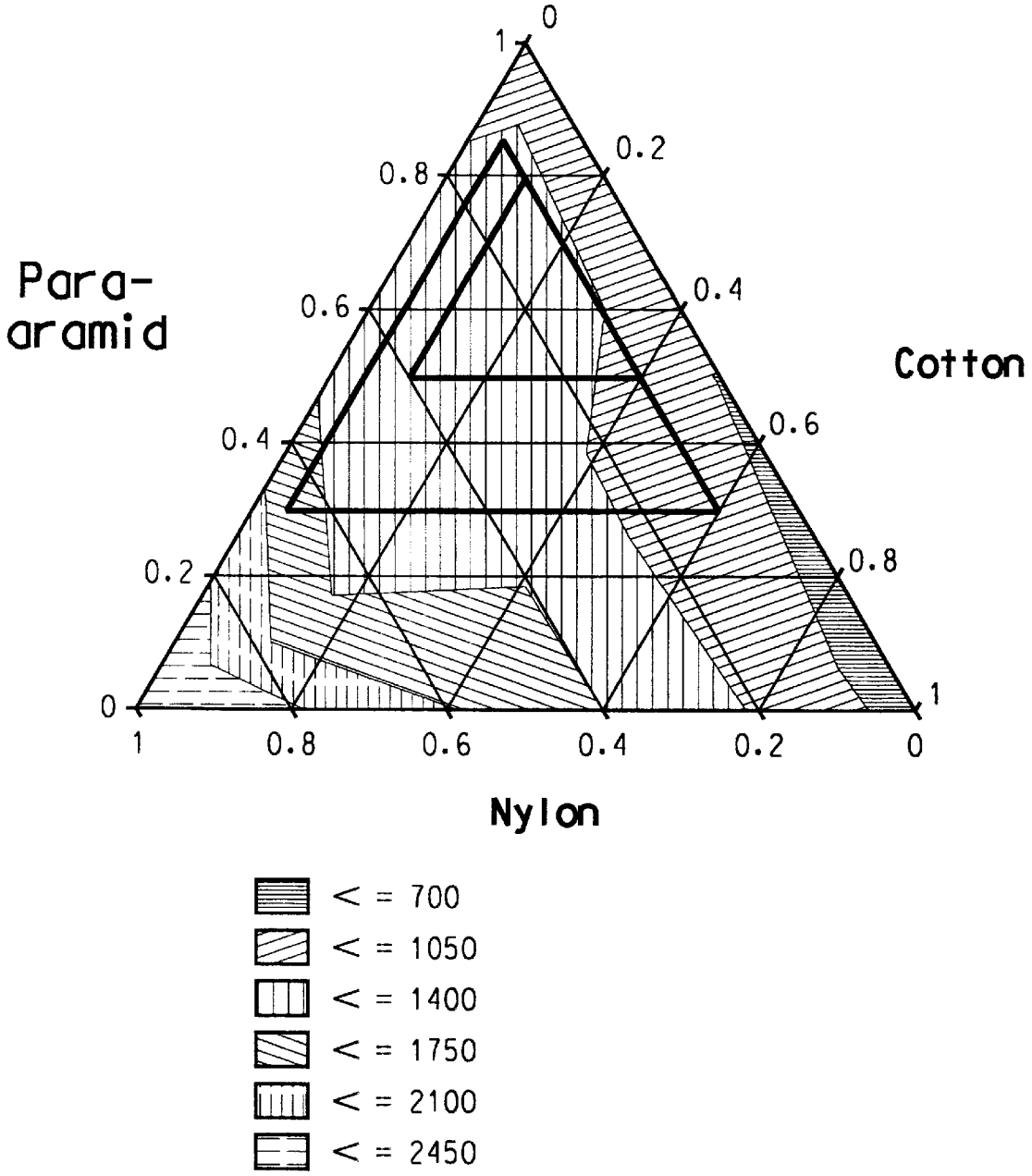
FIG. 4 is a ternary plot of abrasion resistance using the composition of this invention in a steel reinforced fabric.

FIGS. 1 through 4 can be referred to for an understanding of the effect of the components of this composition on the cut resistance of fabrics made using sheath/core yarns with a core of glass fiber (FIG. 1) and steel (FIG. 3) and on the abrasion resistance of those fabrics (FIGS. 2 and 4, respectively). FIGS. 1 and 3 are ternary plots of cut resistance as a function of sheath composition for glass fibers (FIG. 1) and steel (FIG. 3). The axes represent sheath composition concentrations of cotton, nylon, and p-aramid fibers and the fields of value on the plots are cut resistance normalized for a constant weight of fabric composition. Data to construct these plots come from the experiments described in the Example to follow. Although the relationship may be more easily recognized in the case of glass fiber cores than in the case of steel cores, it can be seen that an increase in p-aramid content results in an increased cut existence and that a change in nylon content generally does not yield a large change in cut resistance. As for the abrasion resistance, it can be seen in FIGS. 2 and 4 that abrasion resistance increases with increase in nylon fiber content and is relatively independent of cotton and p-aramid fiber content.

The determination of comfort is difficult and subjective. It has been found, however, that an increase in cotton content in the composition of this invention results in an increase in comfort for use of fabrics with sheath/core yarns having a sheath of this composition. The overall cotton content must be carefully controlled to avoid loss of cut resistance and abrasion resistance; but it has been found that the composition should contain at least 5 weight percent cotton. Less than that amount appears to be too little to have an effect on comfort.

The ranges of component contents that have been found to be appropriate for the composition can be seen in all of the Figs. The composition generally depicted by the area bounded by the triangle ABC is the composition of this invention. Note that the letters A, B, and C are shown only in FIG. 1, although the triangles are delineated in all of the Figs. That triangle denotes a composition that is 5 to 60 weight percent cotton, 10 to 65 weight percent nylon, and 30 to 85 weight percent p-aramid with the understanding, of course, that the weight percents are based on the total weight of the cotton, nylon, and p-aramid fibers and the three components will total 100 weight percent. The preferred composition for this invention is the area bounded by the triangle DEF. Note that the letters D, E, and F are shown only in FIG. 1, although the triangles are delineated in all of the Figs. That triangle denotes a composition that is 10 to 40 weight percent cotton, 10 to 40 weight percent nylon, and 50 to 80 weight percent p-aramid, again, with the understanding that the three components will total 100 weight percent.

The composition of this invention finds use as the sheath in sheath/core yarn construction; and can be made and applied or spun on such core material by well known means. For example, the sheath can be wrapped, wound, served or spun on the core. If wrapped, the sheath fibers are generally put on in a loose form spun by known means, such as, ring spinning, core spinning, air-jet spinning, open end spinning, and then wound around the core at a density sufficient to substantially cover the core. If served, the sheath fibers are generally in a twisted yarn applied in one or more layers around the core at an angle nearly perpendicular with the axis of the core, to cover the core. If spun, the sheath fibers are formed directly over the core by any appropriate core-spinning process such as DREF spinning or so-called Murata jet spinning or another core-spinning process.

The sheath/core yarns of this invention are woven or knitted into fabrics for gloves, aprons, sleeves, and other garments to afford comfortable and effective cut protection. The fabrics are generally made to an areal density of 0.170 to 1.35 kg/m$^2$ (5 to 40 ounces/square yard).

TEST METHODS

Abrasion Resistance

The method used is the "Standard Method for Abrasion Resistance of Textile Fabrics", ASTM Standard D3884-92. In performance of the test, a sample fabric is abraded using rotary rubbing under controlled conditions of pressure and abrasive action. Using a Taber Abraser and a #H-18 abrasive wheel, fabric samples are subjected to abrasion under a load of 500 grams.

The abrasion is continued to rub-through of the fabric sample. The revolutions to rub-through are determined for three samples and the average is reported.

Cut Resistance

The method used is the "Standard Test Method for Measuring Cut Resistance of Materials Used in Protective Clothing", ASTM Standard F 1790-97. In performance of the test, a cutting edge, under specified force, is drawn one time across a sample mounted on a mandrel. At several different forces, the distance drawn from initial contact to cut through is recorded and a graph is constructed of force as a function of distance to cut through. From the graph, the force is determined for cut through at a distance of 25 millimeters and is normalized to validate the consistency of the blade supply. The normalized force is reported as the cut resistance force.

The cutting edge is a stainless steel knife blade having a sharp edge 70 millimeters long. The blade supply is calibrated by using a load of 400 g on a neoprene calibration material at the beginning and end of the test. A new cutting edge is used for each cut test.

The sample is a rectangular piece of fabric cut 50×100 millimeters on the bias at 45 degrees from the warp and fill directions.

The mandrel is a rounded electroconductive bar with a radius of 38 millimeters and the sample is mounted thereto using double-face tape. The cutting edge is drawn across the fabric on the mandrel at a right angle with the longitudinal axis of the mandrel. Cut through is recorded when the cutting edge makes electrical contact with the mandrel.

EXAMPLES

Fabrics were knitted using a variety of sheath/core yarns wherein the cores were glass fibers in some cases and metal fibers in other cases. The fiber composition used for the sheath included a wide concentration array of nylon, p-aramid, and cotton fiber components.

The glass core was made from 100 denier E-glass multifilament fiber having individual filament diameter of about 2 micrometers.

The metal core was made from 38 micrometer diameter stainless steel monofilament.

The sheath compositions were prepared by blending the aramid, nylon, and cotton fibers in proportions specified on the Table below. The aramid fiber component was poly(p-phenylene terephthalamide) fibers about 3.8 centimeters long and 1.6 dtex per filament sold by E. I. du Pont de Nemours and Company under the tradename Kevlar® staple aramid fiber, Type 970. The nylon fiber component was nylon 66 fibers about 3.8 centimeters long and 1.9 dtex per filament sold by E. I. du Pont de Nemours and Company under the trade designation Type 200, Merge 693011. The cotton fiber component was Middling Grade carded cotton.

Enough of the components were used to make nine kilograms of each sheath composition in accordance with the recipes set out for Fabric numbers 1–20 in the Table below. The components were first hand mixed and then fed twice through a picker to make uniform blends. Each of the blended materials was then fed through a standard carding machine used in the processing of short staple ring spun yarns to make carded sliver. The carded sliver was processed using two pass drawing (breaker/finisher drawing) into drawn sliver and processed on a roving frame to make one hank roving. The roving was then divided in two, one half to be used with the glass core fiber and the other half to be used with the steel core.

The sheath-core strands were produced by ring-spinning two ends of a roving and inserting the glass or steel core just prior to twisting. The roving was about 5900 dtex (1 hank count). In these examples, the glass and steel cores were centered between the two drawn roving ends just prior to the final draft rollers. 10/1s cc strands were produced using a 3.25 twist multiplier for each item. After further normal processing, 2 strands were plied together with reverse twist. Three 2.2 kilogram tubes of 10/2s yarns were produced for each Fabric number.

The 10/2s yarns were knitted into samples using a stranded Sheima Seiki glove knitting machine. The machine knitting time was adjusted to produce glove bodies about one meter long—to provide fabric samples for subsequent cut and abrasion testing.

Samples were made by feeding 2 ends of 10/2s to the glove knitting machine to yield fabric samples of about 0.47 kg/m$^2$.

The fabrics were subjected to the aforementioned abrasion and cut resistance tests and the results have been plotted on FIGS. 1 through 4 as a function of sheath component concentration. The plots are normalized to an areal density of 0.47 kg/m$^2$. The data is, also, presented below in tabular form.

While the performance levels, indicated by lines in FIGS. 1 through 4, do not appear in smooth, well-behaved, area, it is clear that a good combination of abrasion resistance and cut resistance is realized with sheath compositions having 5 to 60 weight percent cotton fibers, 10 to 65 weight percent nylon fibers, and 30 to 85 weight percent p-aramid fibers. The best performance results from a sheath composition having 10 to 40 weight percent cotton fibers, 10 to 40 weight percent nylon fibers, and 50 to 80 weight percent p-aramid fibers.

TABLE

| Fabric number | p-aramid (wt %) | Nylon (wt %) | Cotton (wt %) | Cut resist. | Abrasion resist. | Basis wt (kg/m$^2$) |
|---|---|---|---|---|---|---|
| | | | Glass Core | | | |
| 1 | 100 | 0 | 0 | 1878 | 609 | 0.475 |
| 2 | 0 | 100 | 0 | 1041 | 5305 | 0.475 |
| 3 | 0 | 0 | 100 | 942 | 598 | 0.482 |
| 4 | 50 | 50 | 0 | 1596 | 2095 | 0.436 |
| 5 | 50 | 0 | 50 | 1368 | 770 | 0.456 |
| 6 | 0 | 50 | 50 | 986 | 2160 | 0.468 |
| 7 | 33 | 33 | 34 | 1274 | 1829 | 0.504 |
| 8 | 66 | 17 | 17 | 1586 | 1805 | 0.455 |
| 9 | 17 | 66 | 17 | 1165 | 2607 | 0.460 |
| 10 | 17 | 17 | 66 | 1165 | 1173 | 0.484 |
| | | | Steel Core | | | |
| 11 | 100 | 0 | 0 | 4112 | 843 | 0.433 |
| 12 | 0 | 100 | 0 | 2786 | 2516 | 0.477 |
| 13 | 0 | 0 | 100 | 2779 | 571 | 0.497 |
| 14 | 50 | 50 | 0 | 3558 | 1310 | 0.459 |
| 15 | 50 | 0 | 50 | 3613 | 652 | 0.453 |
| 16 | 0 | 50 | 50 | 2985 | 1618 | 0.465 |
| 17 | 34 | 33 | 33 | 3104 | 1107 | 0.437 |
| 18 | 66 | 17 | 17 | 3447 | 1162 | 0.434 |
| 19 | 17 | 66 | 17 | 3317 | 1525 | 0.518 |
| 20 | 17 | 17 | 66 | 2893 | 860 | 0.454 |

What is claimed is:

1. A fiber blend comprising:

5 to 60 weight percent cotton fibers;

10 to 65 weight percent nylon fibers having a length of 2.5 to 15 centimeters and a linear density of 0.5 to 7 dtex;

30 to 85 weight percent p-aramid fibers having a length of 2.5 to 15 centimeters and a linear density of 0.5 to 7 dtex;

wherein the weight percents are based on the total weight of the cotton, nylon, and p-aramid fibers and the cotton, nylon, and p-aramid fibers are combined to yield a substantially uniform mixture.

2. The blend of claim 1 wherein the p-aramid is poly(p-phenylene terephthalamide).

3. The blend of claim 1 wherein the nylon is nylon 66.

4. A sheath/core yarn comprising:

a core of fibrous material having an overall linear density of 100 to 5000 dtex and, a sheath surrounding the core and comprising:

5 to 60 weight percent cotton fibers;

10 to 65 weight percent nylon fibers having a length of 2.5 to 15 centimeters and a linear density of 0.5 to 7 dtex;

30 to 85 weight percent p-aramid fibers having a length of 2.5 to 15 centimeters and a linear density of 0.5 to 7 dtex;

wherein the weight percents are based on the total weight of the cotton, nylon, and p-aramid fibers and the cotton, nylon, and p-aramid fibers are combined to yield a substantially uniform mixture.

5. The sheath/core yarn of claim 4 wherein the sheath is in the form of a yarn wound around the core.

6. The sheath/core yarn of claim 4 wherein the sheath is a mixture of fibers spun directly over the core.

7. The composition of claim 1 wherein the cotton is 10 to 40 weight percent of the composition, the nylon is 10 to 40 weight percent of the composition, and the p-aramid is 50 to 80 weight percent of the composition.

8. The sheath/core yarn of claim 4 wherein the cotton is 10 to 40 weight percent of the composition, the nylon is 10 to 40 weight percent of the composition, and the p-aramid is 50 to 80 weight percent of the composition.

9. The sheath/core yarn of claim 4 knitted or woven into a garment.

10. The sheath/core yarn of claim 9 wherein the garment is a glove, an apron, or a sleeve.

* * * * *